US008459630B2

(12) United States Patent
Watanabe et al.

(10) Patent No.: US 8,459,630 B2
(45) Date of Patent: Jun. 11, 2013

(54) SHEET PROCESSING APPARATUS AND IMAGE FORMING APPARATUS

(75) Inventors: Kiyoshi Watanabe, Matsudo (JP); Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/105,281

(22) Filed: May 11, 2011

(65) Prior Publication Data

US 2011/0278782 A1 Nov. 17, 2011

(30) Foreign Application Priority Data

May 17, 2010 (JP) ..... 2010-113298

(51) Int. Cl.
*B31F 1/00* (2006.01)

(52) U.S. Cl.
USPC ..... 270/45; 270/32; 270/58.07

(58) Field of Classification Search
USPC ..... 270/32, 45, 51, 58.07; 493/406, 493/407
See application file for complete search history.

(56) References Cited

U.S. PATENT DOCUMENTS

| | | | | |
|---|---|---|---|---|
| 2,066,620 | A | 1/1937 | Grammer | |
| 7,285,084 | B2 * | 10/2007 | Fujimoto et al. | 493/442 |
| 7,431,274 | B2 | 10/2008 | Kushida et al. | |
| 7,673,862 | B2 | 3/2010 | Kushida et al. | |
| 2005/0189689 | A1 | 9/2005 | Kushida et al. | |

OTHER PUBLICATIONS

European Search Report, dated Sep. 8, 2011, in European Patent Application No. 11165813.4.

* cited by examiner

*Primary Examiner* — Leslie A Nicholson, III
(74) *Attorney, Agent, or Firm* — Fitzpatrick, Cella, Harper & Scinto

(57) ABSTRACT

A sheet processing apparatus and an image forming apparatus are provided which can stabilize the shape of the spine after a squaring process. To square a spine Sb of a sheet bundle S, a spine processing apparatus 400 which squares the spine Sb performs squaring of the spine by moving the spine Sb which projects from a pair of first nipping rollers 405 and 406 while pressing the spine Sb by means of a pressing roller 411 in a state where the spine Sb is nipped by a pair of second nipping rollers 403 and 404.

12 Claims, 8 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and, more particularly, a sheet processing apparatus and an image forming apparatus which fold and bind a sheet bundle.

2. Description of the Related Art

Conventionally, there are image forming apparatuses such as copying machines or laser beam printers which have a sheet processing apparatus which takes in sheets after images are formed on the sheets, and folds and binds the taken sheets or a sheet bundle. To bind a sheet bundle, these conventional sheet processing apparatuses, for example, form a sheet bundle in a booklet by overlaying a predetermined number of sheets equal to or less than about 20 sheets and folding the sheets by means of a seaming/folding machine of a folding unit. In addition, the sheet bundle folded by this seaming/binding machine includes a sheet bundle which is simply folded, a sheet bundle which is saddle-stitched and folded, or a sheet bundle which is folded by an adhesive (perfect binding) instead of binding a sheet bundle with a thread or staple.

However, any sheet bundle has some elasticity, and therefore, as illustrated in FIGS. 8A and 8B which will be described below, the sheet bundle is folded and then the periphery of a spine which is a folded portion of the sheet bundle swells, thereby forming a U shape. This sheet bundle cannot lie flat and, when the sheets are stacked, the sheet bundle becomes unstable and is likely to collapse. Therefore it is difficult to store or carry a sheet bundle by stacking sheets.

Hence, to prevent this problem, a sheet processing apparatus has a pressing roller which presses the spine of a sheet bundle run along the spine while pressing the spine, and crushes the curved spine and squares the spine in a square shape. This sheet processing apparatus has a nipping unit which nips adjacent portions of the spine from both of front and back surfaces of the sheet bundle, and a pressing unit (pressing roller) which presses the spine projecting outward from the nipping unit from the direction orthogonal to both of the front and back surfaces and squares the spine. Further, when the spine is squared, the spine is squared by moving the nipping unit and the pressing unit integrally along the spine (U.S. Pat. No. 7,431,274).

However, when this conventional sheet processing apparatus presses the spine while moving the pressing unit along the spine, not only the pressed spine but also other spine of the sheet bundle to be pressed next is distorted depending on rigidity or the extent of projection of the sheet bundle. When this pressing unit moves along the spine of the sheet bundle in this state, the spine to be pressed next is also pressed in a distorted state.

Further, when the spine to be pressed next is pressed in the distorted state in this way, there is a problem that the shape after a squaring process does not become stable and how the shape looks is not good, for example, a wrinkle is made. In addition, it is difficult to stabilize the amount of distortion or how the sheet bundle is distorted when the spine is pressed, and, further, when distortions before pressing are different, how the sheet bundle is pressed changes.

The present invention is made in view of the above-described problem, and the present invention provides a sheet processing apparatus and an image forming apparatus which can stabilize the shape after a spine squaring process.

SUMMARY OF THE INVENTION

The present invention is the sheet processing apparatus having a processing portion which moves along a spine while pressing the spine of a folded sheet bundle to perform a deforming process on the spine. The processing portion includes a first nipping portion which nips the sheet bundle in a position spaced at a predetermined distance from the spine of the folded sheet bundle, a pressing portion which is provided corresponding to the first nipping portion in a moving direction of the processing portion, and which presses and deforms the spine in a direction orthogonal to a direction in which the first nipping portion nips the sheet bundle, and a second nipping portion which is provided downstream of the moving direction of the first nipping portion and which nips the spine.

As in the present invention, by nipping the spine by means of the second nipping portion prior to moving the spine while pressing by means of the pressing portion the end face of the spine which is projected and nipped by the first nipping portion, it is possible to stabilize the shape after a spin squaring process.

Further features of the present invention will become apparent from the following description of exemplary embodiments with reference to the attached drawings.

DESCRIPTION OF THE EMBODIMENTS

Figure 1:
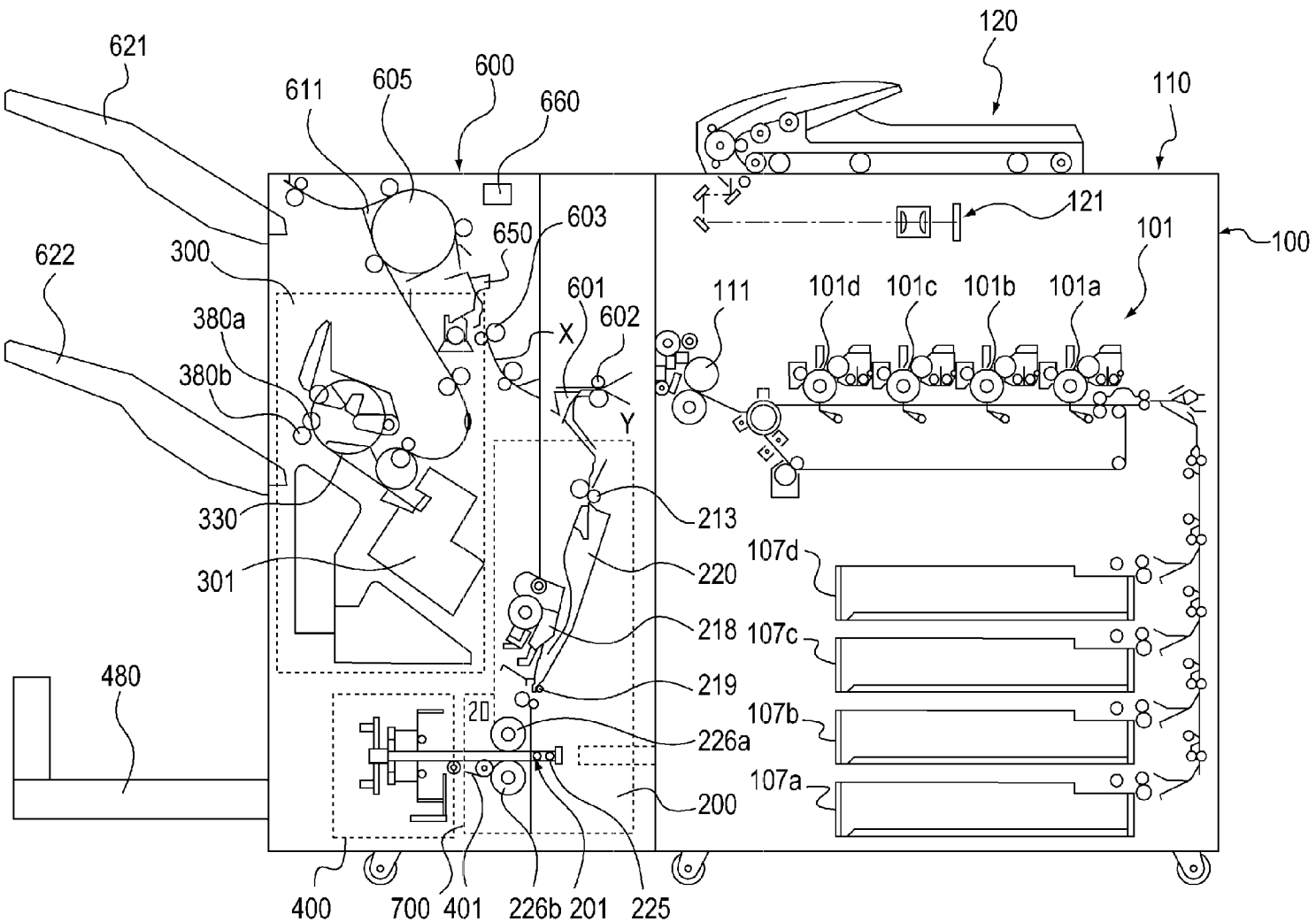
FIG. 1 is a view illustrating a configuration of a copying machine which is an example of an image forming apparatus having a sheet processing apparatus according to an embodiment of the present invention.

Hereinafter, an embodiment of the present invention will be described in detail using drawings. FIG. 1 is a view illustrating a configuration of a copying machine which is an example of an image forming apparatus having a sheet processing apparatus according to an embodiment of the present invention.

FIG. 1 illustrates a monochrome/color copying machine (hereinafter "copying machine") 110 and a copying machine main body 100, where a finisher 600 which is a sheet processing apparatus is connected to this copying machine main body 100. Further, an original reading portion (image reader) 121 is provided in the upper part of the copying machine main body 100, and an original conveying apparatus 120 which automatically reads a plurality of sheets of original is provided on the upper surface of the copying machine main body 100.

Further, when a feed signal is output in this copying machine 110, sheets are fed from cassettes 107*a* to 107*d* provided in the copying machine main body 100, to an image forming portion 101. Then, toner images of four colors are transferred onto these sheets by photosensitive drums 101*a* to 101*d* of yellow, magenta, cyanogen and black which are each an image forming unit, and these sheets are conveyed to a fixing apparatus 111. Next, transferred images are permanently fixed in the fixing apparatus 111, and sheets on which images are fixed are then discharged from the copying machine main body 100 and conveyed to the finisher 600.

Here, the finisher 600 sequentially takes in the sheets discharged from the copying machine main body 100, and performs processing of aligning a plurality of taken sheets and binding the sheets as one bundle. Further, various processes such as staple process of binding the rear end of the taken sheet bundle (upstream end in the sheet conveying direction), a punching process of making a hole in the vicinity of the rear end of the taken sheets, and a sort/non-sort process, a folding process of folding the sheet bundle and a saddle stitching process, are performed.

In addition, with the present embodiment, the finisher 600 includes the saddle stitch processing apparatus 200, a side stitch processing apparatus 300 and the spine processing apparatus 400 which is a spine flattening processing apparatus. In addition, the saddle stitch processing apparatus 200 and the spine processing apparatus 400 form the saddle stitch binding processing apparatus 700.

Further, this finisher 600 can process the sheets discharged from the copying machine main body 100 online. Further, there are cases where the finisher 600 is optionally used, and therefore the copying machine main body 100 can be individually used. Further, the finisher 600 and the copying machine main body 100 may be integrally formed.

Further, this finisher 600 has a pair of inlet rollers 602 for guiding sheets discharged from the copying machine main body 100 to the inside. In the downstream side of the pair of inlet rollers 602, a switching member 601 is provided which selectively guides sheets to a side stitch binding path X or a saddle stitch binding path Y.

Then, the sheets guided to the side stitch binding path X by the switching member 601 are conveyed toward a buffer roller 605 through a pair of conveying rollers 603. Here, the buffer roller 605 is a roller which stacks and winds therearound a predetermined number of sheets conveyed to the outer periphery of the buffer roller 605. The sheets conveyed to the buffer roller 605 are stacked on a sample tray 621 by the switching member 611 arranged in the downstream, or are stacked on an intermediate process tray 330 in the side stitch processing apparatus 300 by a pair of discharge rollers 320.

Then, the sheets stacked in a bundle on the intermediate process tray 330 are aligned and stapled by a stapler 301 where necessary, and are discharged on a stack tray 622 by a pair of bundle discharge rollers 380*a* and 380*b*. In addition, a punch unit 650 is provided between the pair of conveying rollers 603 and the buffer roller 605, and operates where necessary to make holes in the vicinity of the rear ends of conveyed sheets.

By contrast with this, the sheets guided on the side stitch binding path Y by the switching member 601 are then accommodated in an accommodating guide 220 of the saddle stitch processing apparatus 200 by a pair of conveying rollers 213, and are conveyed until the leading edges of the sheets contact a lifting and lowering sheet positioning member which is not illustrated. In addition, the stapler 218 is provided in the middle of the accommodating guide 220, and binds the center of the sheet bundle in collaboration with an anvil 219.

Further, in the downstream of the stapler 218, a pair of folding rollers 226*a* and 226*b* forming a sheet folding portion which folds the sheet bundle are provided, and a projecting member 225 is provided in a position opposing to the pair of these folding rollers 226*a* and 226*b*. The pair of folding rollers 226*a* and 226*b* and the projecting member 225 form a folding apparatus 201 which folds the sheet bundle.

Then, the saddle stitch processing apparatus 200 employing this configuration conveys a predetermined number of sheets until the leading edges contact the sheet positioning member to bind as a sheet bundle, then selectively binds the center part by means of the stapler 218 and further binds the bound sheet bundle.

In addition, when a sheet bundle is folded in this way, the sheet positioning member is lowered such that the stapling position of the sheet bundle opposes to the center positions (nip) of the pair of folding rollers 226*a* and 226*b*. Then, the projecting member 225 projects toward the sheet bundle, so that the sheet bundle is pushed into between the pair of folding rollers 226*a* and 226*b* (nip) and conveyed by being nipped by the pair of folding rollers 226*a* and 226*b* and folded in two. By this means, the sheet bundle is formed in a saddle-stitched booklet.

In addition, the saddle stitch processing apparatus 200 which forms this folding portion can also fold sheets or a sheet bundle without binding the sheets or sheet bundle. In this case, the sheets are folded without performing the operation of the stapler 218 among the above-described processes. Further, the saddle-stitched sheet bundle or folded sheets are conveyed to the spine processing apparatus 400 as is by the pair of folding rollers 226*a* and 226*b* and a bound bundle conveying belt 401. Then, the spine of the sheet bundle is deformed (squared) by the spine processing apparatus 400 which forms a processing portion which performs squaring of the spine in a square shape as a deformation process, and is discharged to a folded bundle discharge tray 480.

Figure 2:
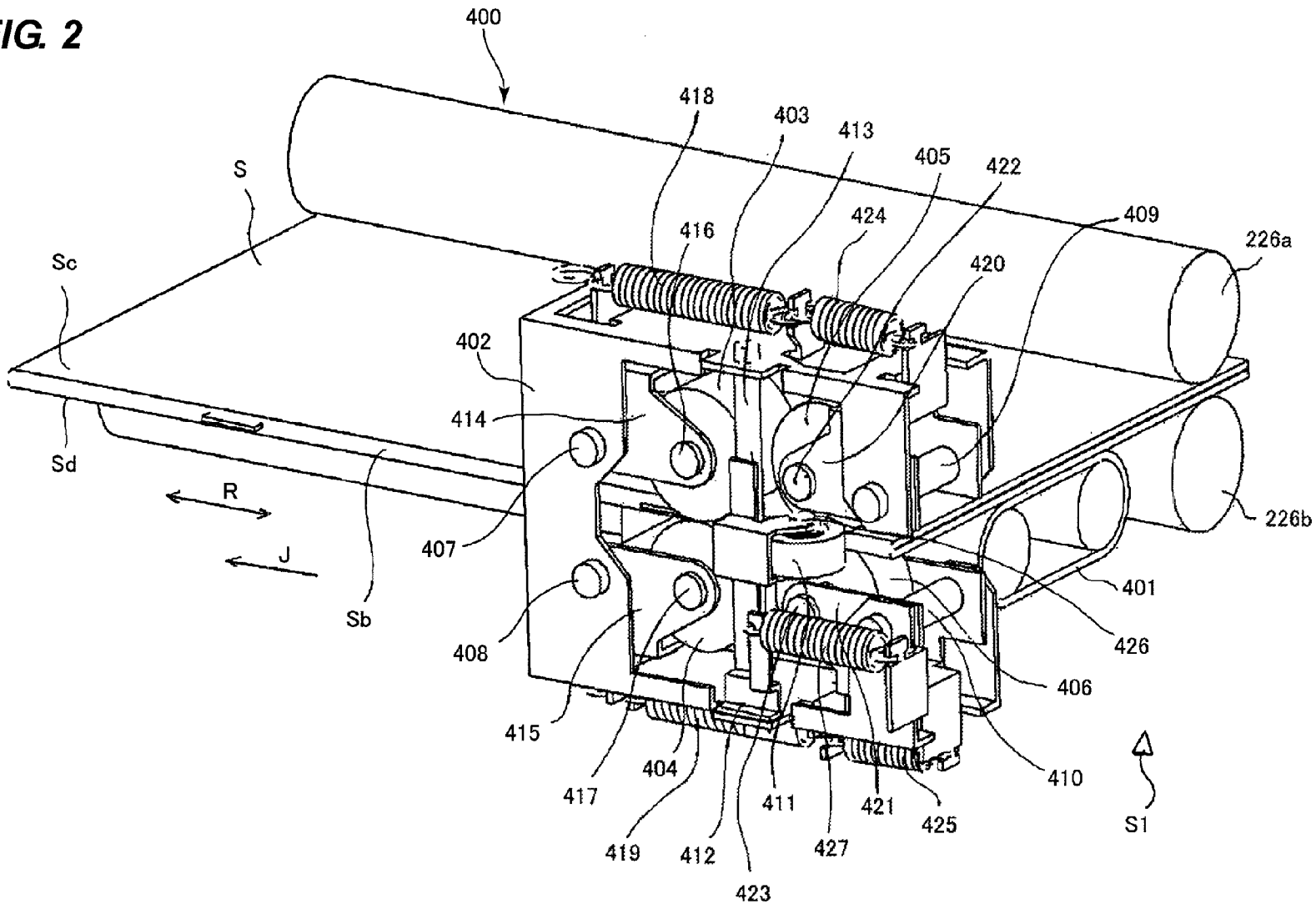
FIG. 2 is a first view for describing a configuration of a spine processing apparatus which is the above sheet processing apparatus provided in a finisher.

Here, as illustrated in FIG. 2, the spine processing apparatus 400 includes a pair of first nipping rollers 405 and 406, having a first upper nipping roller 405 and a first lower nipping roller 406, which is served as a first nipping portion for nipping (nipping and pressing) the sheet bundle in a position spaced at a predetermined distance from the spine of the sheet bundle. Further, the spine processing apparatus 400 has a pressing roller 411, served as a pressing portion, which is provided corresponding to the pair of first nipping rollers 405 and 406 to press the end face of the downstream side in the conveying direction of the spine of the sheet bundle from a direction orthogonal to the nipping direction of the pair of first nipping rollers 405 and 406. Further, this spine processing apparatus 400 includes a pair of second nipping rollers 403 and 404, having a second upper nipping roller 403 and a second lower nipping roller 404, which is served as a second nipping portion nipping (nipping and pressing) the spine of the sheet bundle.

Further, the pair of second nipping rollers 403 and 404, the pair of first nipping rollers 405 and 406 and the pressing roller 411 are integrally supported in a housing 402. This housing 402 is attached to an endless belt or chain which is not illustrated and which is circulated by a housing conveying motor M1 illustrated in FIG. 4 which will be described below, and moves when the belt or chain circulates.

In addition, in FIG. 2, a second upper nipping roller support shaft 407 is horizontally and rotatably supported by the housing 402. One end of this second upper nipping roller support shaft 407 is provided with a second upper pressurizing arm 414 which rotatably supports the second upper nipping roller 403 by the second upper pressurizing arm shaft 416 provided nearly horizontally and rotatably. Further, a second upper pressurizing spring 418 is provided between the other end of the second upper pressurizing arm 414 and the housing 402, and biases the second upper nipping roller 403 toward the sheet bundle.

The second lower nipping roller support shaft 408 is horizontally and rotatably supported in the housing 402. One end of this second lower nipping roller support shaft 408 is provided with a second lower pressurizing arm 415 which rotatably supports the second lower nipping roller 404 by the second lower pressurizing arm shaft 417 provided nearly horizontally and rotatably. Further, a second lower pressurizing spring 419 is provided between the other end of the second lower pressurizing arm 415 and the housing 402, and biases the second lower nipping roller 404 toward the sheet bundle.

This configuration allows the second upper nipping roller 403 and the second lower nipping roller 404 to nip adjacent portions Sc and Sd of both of the top and back surfaces of a spine Sb and spine Sb of the sheet bundle S by means of pulling forces of the second upper pressurizing spring 418 and the second lower pressurizing spring 419.

The first upper nipping roller support shaft 409 is horizontally and rotatably supported in the housing 402. One end of this first upper nipping roller support shaft 409 is provided with a first upper pressurizing arm 420 which rotatably supports the first upper nipping roller 405 by the first upper pressurizing arm shaft 422 provided nearly horizontally and rotatably. Further, a first upper pressurizing spring 424 is provided between the other end of the first upper pressurizing arm 420 and the housing 402, and biases the first upper nipping roller 405 toward the sheet bundle.

The first lower nipping roller support shaft 410 is horizontally and rotatably supported in the housing 402. One end of this first lower nipping roller support shaft 410 is provided with a first lower pressurizing arm 421 which rotatably supports the first lower nipping roller 406 by the first lower pressurizing arm shaft 423 provided nearly horizontally and rotatably. Further, a first lower pressurizing spring 425 is provided between the other end of the first lower pressurizing arm 421 and the housing 402, and biases the first lower nipping roller 406 toward the sheet bundle.

This configuration allows the first upper nipping roller 405 and the first lower nipping roller 406 to nip adjacent portions Sc and Sd of both of the top and back surfaces of the spine Sb of the sheet bundle S by means of pulling forces of the first upper pressurizing spring 424 and the first lower pressurizing spring 425.

Further, in FIG. 2, a support shaft 413 is horizontally and rotatably supported in the housing 402. This support shaft 413 is provided with a pressurizing arm 412 which rotatably supports the pressing roller 411 by means of the pressing roller shaft 426 extending in up and down directions. Further, a pressing spring 427 is provided between this pressurizing arm 412 and the housing 402, and presses the pressing roller 411 against the spine Sb of the sheet bundle. This configuration allows the pressing roller 411 to press this spine Sb of the sheet bundle in a direction parallel to the conveying direction by means of the pulling force of the pressing spring 427.

Figure 3A:
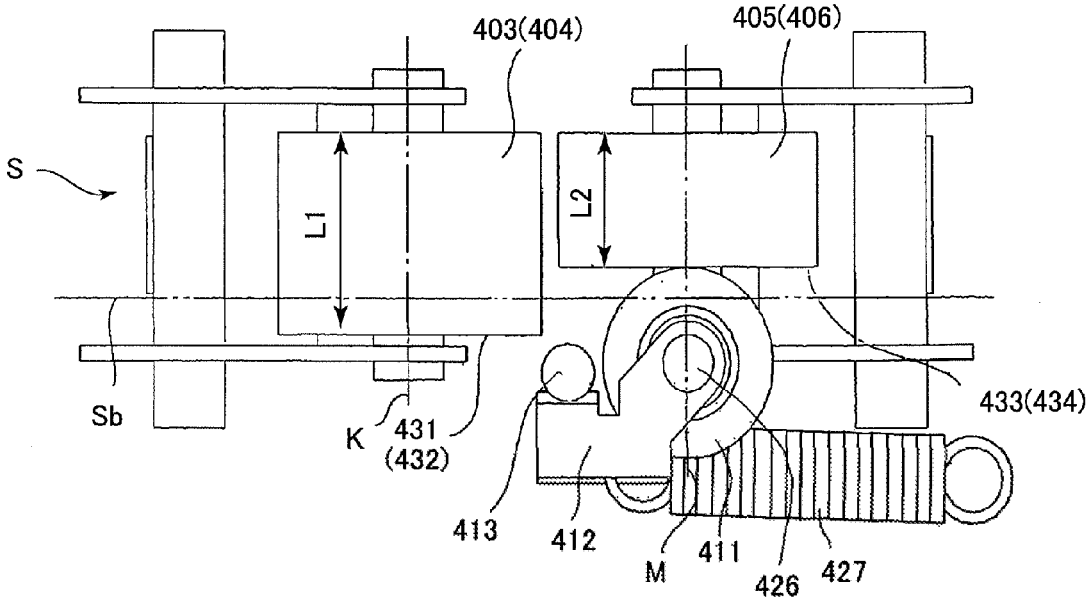
FIGS. 3A and 3B are second views for describing configurations of the above spine processing apparatus.
Figure 3B:
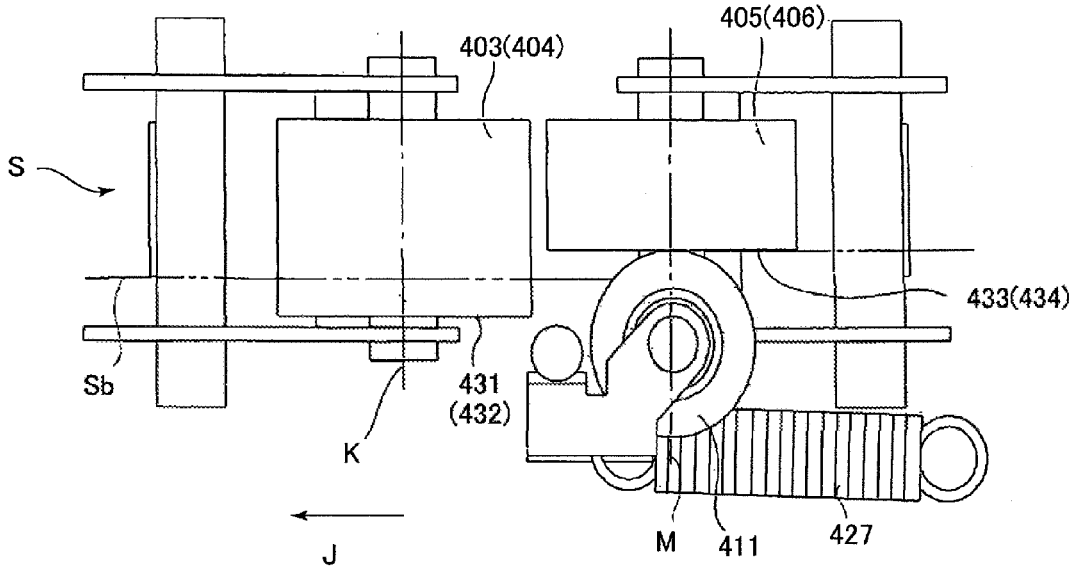

Meanwhile, as illustrated in FIGS. 3A and 3B, the width L1 between the pair of second nipping rollers 403 and 404 and the width L2 between the pair of first nipping rollers 405 and 406 hold the relationship of L1>L2. Hence, the positions of sheet bundle conveying direction downstream side ends 431 and 432 of the pair of the second nipping rollers 403 and 404 are in the downstream in the sheet bundle conveying direction compared to the positions of the sheet bundle conveying direction downstream side ends 433 and 434 of the pair of first nipping rollers 405 and 406. Further, the pressing roller 411 is arranged in a position opposing to the nip of the pair of first nipping rollers 405 and 406, and is pressed against the sheet bundle conveying direction downstream side ends 433 and 434 of the pair of second nipping rollers 403 and 404 by the pressing spring 427.

In addition, the chain double-dashed line of FIG. 3A illustrates the state before the spine Sb of the sheet bundle S is nipped and pressed, and the chain double-dashed line of FIG. 3B illustrates the state where the spine Sb of the sheet bundle S is nipped and pressed. Further, the arrow J indicates the direction in which, when the spine processing apparatus 400 performs a spine process, the spine processing apparatus 400 moves the spine Sb while pressing the spine Sb of the sheet bundle S by means of the pressing roller 411.

Here, the pair of first nipping rollers 405 and 406 is positioned in the upstream of the moving direction of this spine processing apparatus 400 with respect to the pair of second nipping rollers 403 and 404. By this means, when the spine processing apparatus 400 moves in this direction, the pair of second nipping rollers 403 and 404 moves prior to the pair of first nipping rollers 405 and 406 and the pressing roller 411, and nip the spine Sb and adjacent portions of the sheet bundle S from both sides. Afterwards, the pair of first nipping rollers 405 and 406 then nips the adjacent portions of the sheet bundle S from both sides.

Figure 4:
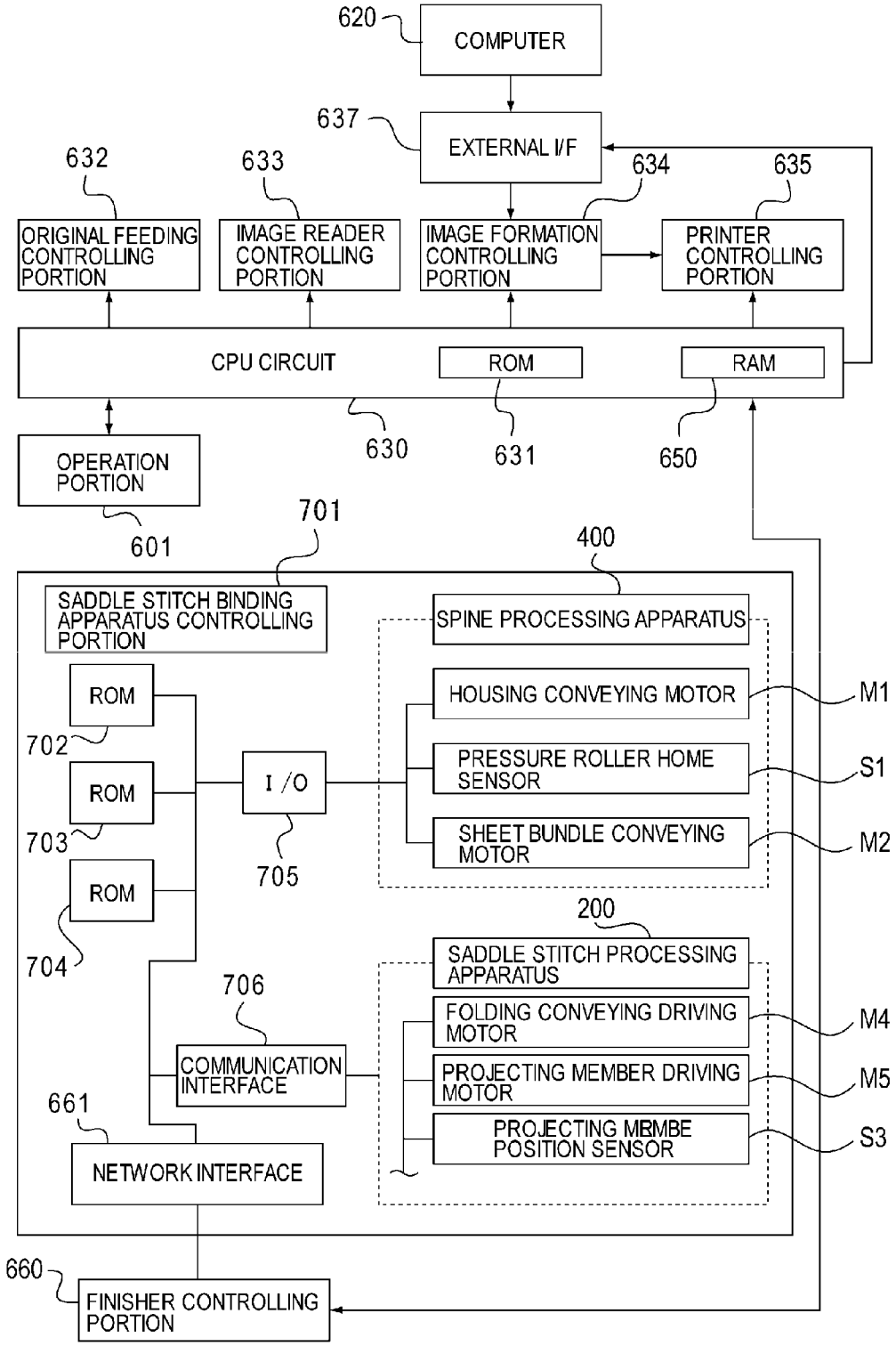
FIG. 4 is a control block diagram of the above copying machine.

FIG. 4 is a control block diagram of the copying machine 110, and, in FIG. 4, a CPU circuit 630 is arranged in a predetermined position of the copying machine main body 100. This CPU circuit 630 includes a ROM 631 which stores control programs, an area which temporarily retains control data and a RAM 650 which is used as a working area for computation involved with the control.

Further, in FIG. 4, an external interface (I/F) 637 is provided between the copying machine 110 and a computer (external PC) 620. When receiving print data from the computer 620, this external interface 637 expands this data into a bit-mapped image, and outputs the resultant to the image formation controlling portion 634. Then, this image formation controlling portion 634 outputs this data to a printer controlling portion 635, and the printer controlling portion 635 outputs the data from the image formation controlling portion 634 to the image forming portion 101. In addition, an image of original read by an original reading portion 121 is output from the image reader controlling portion 633 to the image formation controlling portion 634, and the image formation controlling portion 634 outputs this image output to the printer controlling portion 635.

Further, the operation portion 610 includes a plurality of keys for setting various functions related to image formation, and a display portion on which a set state is displayed. Furthermore, the operation portion 610 outputs, to the CPU circuit 630, a key signal corresponding to an operation of each key carried out by a user, and displays corresponding information on the display portion based on a signal from the CPU circuit 630. The CPU circuit 630 controls the image formation controlling portion 634 according to the control program stored in the ROM 631 and the setting in the operation portion 610, and controls the original conveying apparatus 120 through the original feeding controlling portion 632. Further, the CPU circuit 630 respectively controls the original reading portion 121 through the image reader controlling portion 633, the image forming portion 101 through the printer controlling portion 635 and the finisher 600 through the finisher controlling portion 660.

In addition, with the present embodiment, a finisher controlling portion 660 is mounted in the finisher 600 and controls driving of the finisher 600 by interchanging information with the CPU circuit 630. Further, it may be possible to integrally dispose the finisher controlling portion 660 and the CPU circuit 630 on the apparatus main body side to directly control the finisher 600 from the apparatus main body side.

Further, this finisher controlling portion 660 is connected with a saddle stitch binding apparatus controlling portion 701 through a network interface 861. Here, this saddle stitch biding apparatus controlling portion 701 includes a CPU 702, a RAM 703 and a ROM 704. While sending and receiving signals to and from the finisher controlling portion 660, the CPU 702 controls the spine processing apparatus 400 and the saddle stitch processing apparatus 200. The RAM 703 stores processing information of the spine processing apparatus 400 and the saddle stitch processing apparatus 200. The ROM 704 stores control procedures of the spine processing apparatus 400 and the saddle stitch processing apparatus 200.

The spine processing apparatus 400 includes a housing conveying motor M1 which moves the housing 402, a sheet bundle conveying motor M2 which drives a bound bundle conveying belt 401, and a pressing roller home sensor S1 which detects whether or not the pressing roller 411 is in a home position through the housing 402. Further, the spine processing apparatus 400 is connected to the CPU 702 thorough the I/O 705.

Further, based on signals from the CPU 702, the spine processing apparatus 400 moves the housing 402 by means of the housing conveying motor M1 and drives the bound bundle conveying belt 401 by means of the sheet bundle conveying motor M2. Further, the CPU 702 detects whether or not the pressing roller 411 is in a home position by means of the pressing roller home sensor S1.

The saddle stitch processing apparatus 200 includes the folding conveying driving motor M4 which drives rotation of the pair of folding rollers 226*a* and 226*b*, and a projecting member driving motor M5 which makes the projecting member 225 reciprocate. Further, the saddle stitch processing apparatus 200 includes a projecting member position sensor S3 which detects the position where the projecting member 225 is projected at maximum, and is connected to the CPU 702 through a communication interface 706.

Further, based on signals from the CPU 702, the saddle stitch processing apparatus 200 drives rotation of the pair of folding rollers 226*a* and 226*b* by means of the folding roller driving motor M4, and makes the projecting member 225 reciprocate by means of the projecting member driving motor M5. Further, the CPU 702 detects the position where the projecting member 225 projects at maximum, by means of the projecting member position sensor S3.

Figure 5:
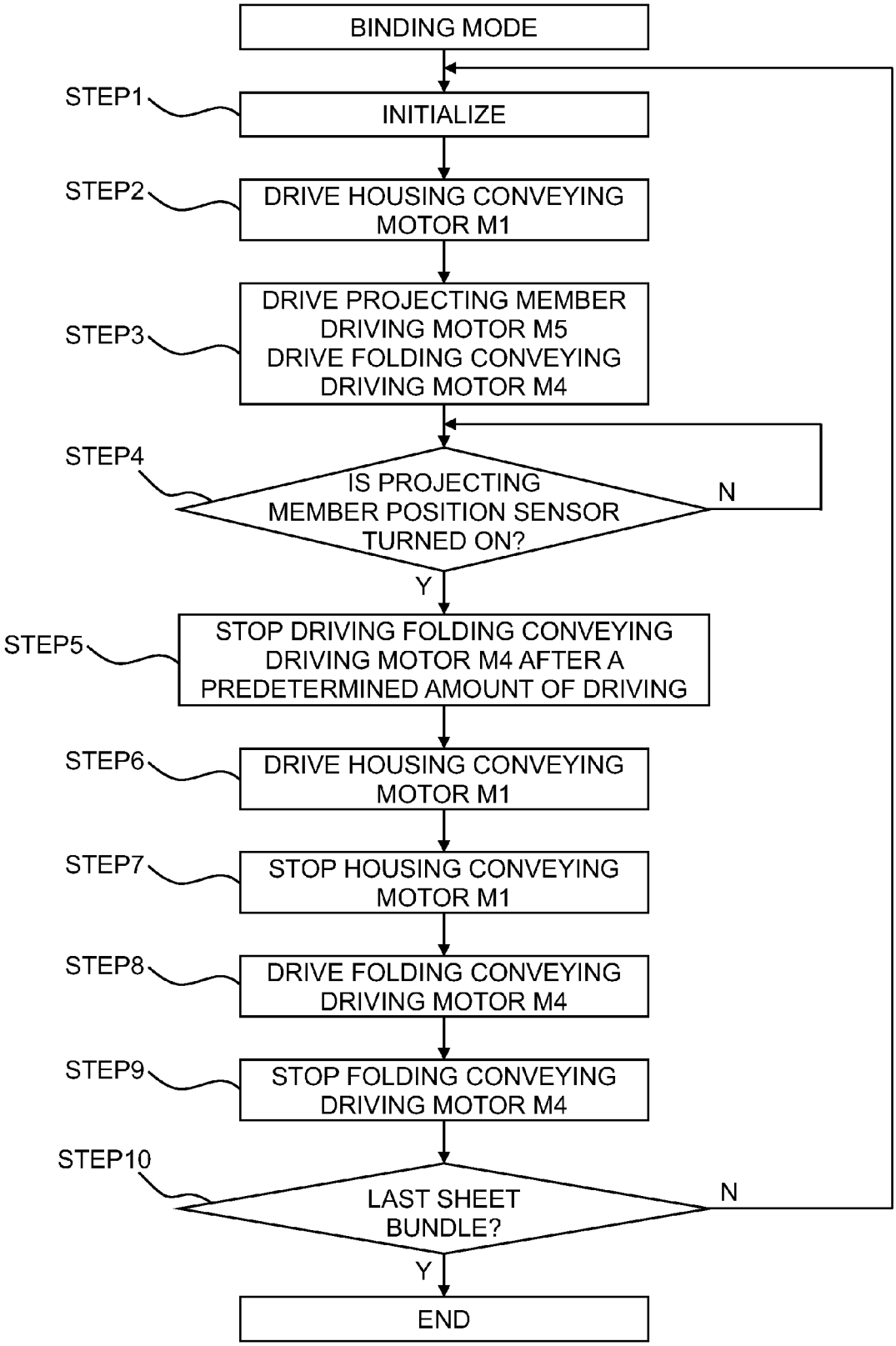
FIG. 5 is a flowchart illustrating a saddle stitch process and spine process control of the above finisher.

Next, a saddle stitch process of the saddle stitch processing apparatus 200 and spine process control of the spine processing apparatus 400 in the saddle stitch binding apparatus controlling portion 701 will be described with reference to the flowchart illustrated in FIG. 5.

When a binding process starts, the saddle stitch binding apparatus controlling portion 701 first performs initialization to move the spine processing apparatus 400 to the home position (STEP 1). Then, the saddle stitch binding apparatus controlling portion 701 drives the housing conveying motor M1 (STEP 2), and moves the spine processing apparatus 400 such that a nip line K (see FIGS. 3A and 3B) of the pair of second nipping rollers 403 and 404 comes to a position closer to the outer side than the end face of the sheet bundle S. In addition, at this time, the pair of second nipping rollers 403 and 404 and the pair of first nipping rollers 405 and 406 do not hold the sheet bundle and are in contact with each other.

Then, when the stapled sheet bundle is lowered such that the center part of the sheet bundle opposes to the center position (nip) of the pair of folding rollers 226*a* and 226*b*, the folding conveying driving motor M4 and the projecting member driving motor M5 are driven (STEP 3). Thus, the projecting member 225 projects toward the sheet bundle, and the sheet bundle is pushed into between the pair of folding rollers 226*a* and 226*b* (nip), is nipped and conveyed by the pair of folding rollers 226*a* and 226*b* and is folded into two.

Further, the sheet bundle conveying motor M2 is driven. Thus, the sheet bundle folded into two is conveyed by the bound bundle conveying belt 401. Then, the projecting member 225 is placed in the position where the projecting member 225 projects at maximum, and, when the projecting member position sensor S3 which detects this projection is turned on (Y in STEP 4), the folding conveying driving motor M4 is stopped after a predetermined amount of driving (STEP 5). Further, the sheet bundle conveying motor M2 is stopped. Therefore, the pair of folding rollers 226*a* and 226*b* and the bound bundle conveying belt 401 are stopped and conveyance of the sheet bundle is stopped.

In addition, a conveyance stop position refers to a position where the spine Sb of the sheet bundle S is in the upstream of the sheet bundle conveying direction downstream side ends 431 and 432 of the pair of second nipping rollers 403 and 404 and is in the downstream of the sheet bundle conveying direction downstream side ends 433 and 434 of the pair of first nipping rollers 405 and 406. That is, with the present embodiment, after the sheet bundle is folded into two, the sheet bundle is stopped in a state where the spine Sb projects from the pair of first nipping rollers 405 and 406.

Figure 6A:
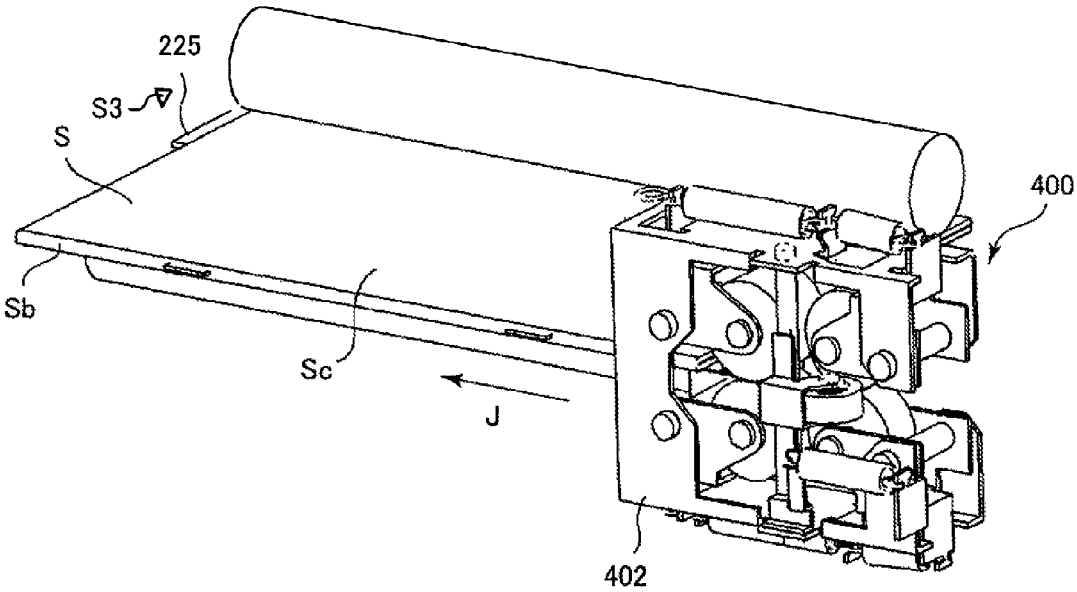
FIGS. 6A and 6B are first views for describing spine process operations of a spine processing apparatus provided in the above finisher.
Figure 6B:
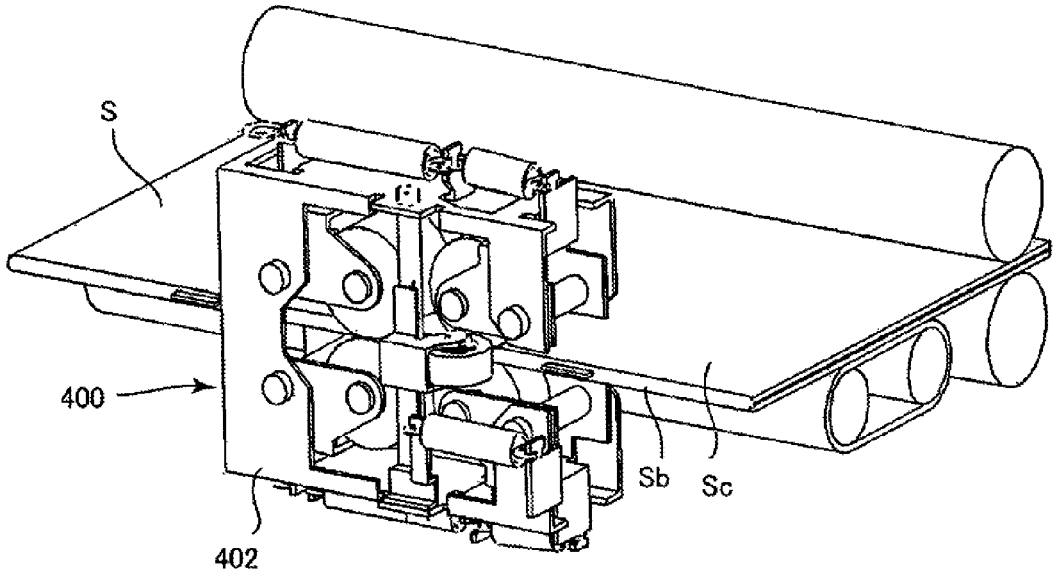

Next, when the sheet bundle S is positioned in this way, the housing conveying motor M1 is driven (STEP 6). As a result, the spine processing apparatus 400 starts moving in the direction of the arrow J from a stand-by position in the lateral side of the sheet bundle moving direction. Further, the pair of second nipping rollers 403 and 404 then starts nipping the spine Sb and the adjacent portions of the sheet bundle S from both sides. Next, the pair of first nipping rollers 405 and 406 moves while nipping the adjacent portions Sc (Sd) of the spine Sb from both sides, and the pressing roller 411 moves while nipping the end face of the spine Sb of the sheet bundle S. Then, the spine Sb is squared as illustrated in FIG. 6B.

In addition, to adequately deform the spine Sb, the amount of projections of the spine Sb from the pair of first nipping rollers 405 and 406 is changed according to rigidity of the sheet bundle determined based on the thickness, the basis weight, and the number of sheets forming the sheet bundle S. For example, when the rigidity of the sheet bundle is higher, the sheet bundle is not likely to be deformed compared to the sheet bundle having lower rigidity, and therefore the position to stop the sheet bundle is changed such that the amount of projection becomes greater than the sheet bundle having lower rigidity. Further, the intervals between the pair of second nipping rollers 403 and 404, the pair of first nipping rollers 405 and 406, and the pressing roller 411 are determined in an adequate range according to the rigidity of the sheet bundle which is processed such that the amount of distortion of the spine Sb or how the spine Sb is distorted becomes stable.

Here, when the pressing roller 411 moves the spine Sb while pressing the lateral face of the spine Sb by means of the pressing roller 411 in a state where the adjacent portions are nipped, the spine Sb is nipped by the pair of second nipping rollers 403 and 404. Hence, the leading area of the sheet bundle S, with respect to the area which is pressed, is pulled between the nip line K and the nip line M illustrated in FIGS. 3A and 3B. Further, in a state where the spine Sb is pulled in this way, by moving the pressing roller 411, it is possible to prevent the area of the spine Sb which starts being pressed, from being distorted in advance. As a result, the amount of distortion of the spine Sb and how the spine Sb is distorted due to pressing force of the pressing roller 411 becomes stable, and the shape of the spine Sb after a pressing process becomes stable.

Figure 7:
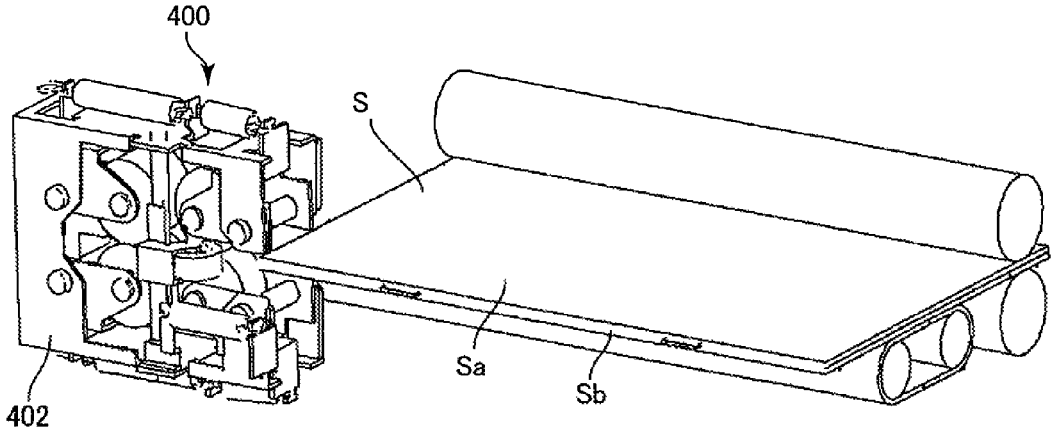
FIG. 7 is a second view for describing a spine process operation of the above spine processing apparatus.
Figure 8A:
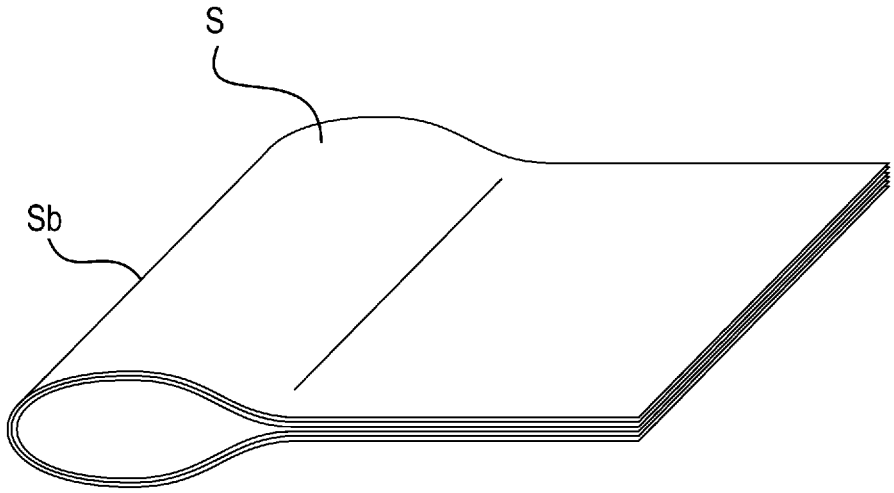
FIGS. 8A and 8B are views illustrating the states of a sheet bundle which is processed by the above spine processing apparatus.
Figure 8B:
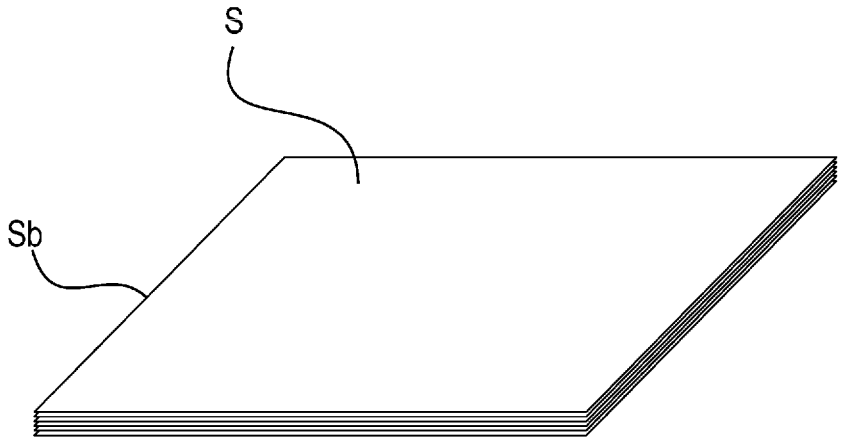

Next, when the spine processing apparatus 400 moves to the other end of the sheet bundle S as illustrated in FIG. 7, the housing conveying motor M1 is stopped (STEP 7), and a process to flatten the spine is finished. Therefore, the spine Sb which is swelled and curved as illustrated in FIG. 8A has a crushed and squared shape as illustrated in FIG. 8B.

Next, the sheet bundle conveying motor M2 and the folding conveying driving motor M4 are driven (STEP 8) to resume conveyance of the sheet bundle S by means of the pair of folding rollers 226*a* and 226*b* and the bound bundle conveying belt 401. Thus, the sheet bundle S is discharged to and sequentially stacked on the folded bundle discharge tray 480. Further, when the sheet bundle S is discharged to the folded bundle discharge tray 480, the folding conveying driving motor M4 is stopped (STEP 9). In addition, when this sheet bundle discharge operation is finished, whether or not the discharged sheet bundle S is the last sheet bundle is checked (STEP 10). Further, if the discharged sheet bundle is not the last sheet bundle (N in STEP 10), STEP 1 to STEP 8 are repeated, and, if the discharged sheet bundle S is the last sheet bundle (Y in STEP 10), the saddle stitch process is finished.

As described above, with the present embodiment, to square the spine Sb, the spine Sb of the sheet bundle S is nipped by the pair of second nipping rollers 403 and 404, and the adjacent portions of the spine Sb are nipped by the pair of first nipping rollers 405 and 406. That is, prior to moving the spine by pressing the end face of the spine projected by the pressing roller 411 and nipped by the pair of first nipping rollers 405 and 406, the spine is nipped by the pair of second nipping rollers 403 and 404. With this configuration, when the end face of the spine Sb is pressed, the area of the spine Sb to be pressed is pulled by the pair of second nipping rollers 403 and 404 and the pair of first nipping rollers 405 and 406.

Then, by pressing the spine Sb in this pulled state, it is possible to prevent the area of the spine to be pressed next from being distorted in advance due to movement of the pressing roller 411. As a result, it is possible to stably press the spine Sb and stabilize the shape of the spine Sb after the squaring process. That is, when the spine Sb is deformed, by pressing the spine Sb by pulling the spine Sb, it is possible to stabilize the amount of distortion and how the spine Sb is distorted when the spine Sb is pressed, and stabilize the shape of the spine Sb after the squaring process.

In addition, with the present embodiment, although the first nipping portion which projects and nips the spine of a sheet bundle is formed with a pair of rollers such as the pair of first nipping rollers 405 and 406, the present invention is not limited to this. For example, when the first nipping portion is provided upstream of the moving direction of the pair of second nipping rollers 403 and 404, and the first nipping portion includes at least one guide member which do not rotate instead of the pair of first nipping rollers 405 and 406, the same effect can be provided.

Further, although, with the present embodiment, the pair of second nipping rollers 403 and 404 is arranged to take a lead of the pair of first nipping rollers 405 and 406 and the pressing roller 411 in the moving direction, the present invention is not limited to this. For example, it may be possible to provide two pairs of second nipping rollers 403 and 404 on both sides (upstream side and downstream side) of the moving direction of the pair of first nipping rollers 405 and 406, and form each pair of second nipping rollers 403 and 404 with a pair of rotating members which can come into contact and separate from each other.

Further, when the spine processing apparatus 400 moves from the stand-by position, upstream one of the two pairs of second nipping rollers of the moving direction is separated by the separating mechanism. Further, when the spine processing apparatus 400 moves in an opposite direction to return to the stand-by position, upstream one of the two pairs of second nipping rollers of the moving direction in the opposite direction is separated. As a result, not only when the spine processing apparatus 400 moves in one direction of reciprocating movement, but also when the spine processing apparatus 400 moves in the opposite direction of reciprocating movement, it is possible to perform the squaring process which is a deforming process according to the present invention, and increase productivity by making reciprocation along the spine and squaring a spine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-113298, filed May 17, 2010, which is hereby incorporated by reference herein in its entirety.

What is claimed is:

1. A sheet processing apparatus comprising a processing portion which moves along a spine of a folded sheet bundle while pressing the spine of the folded sheet bundle to deform the spine into a square shape, wherein the processing portion includes:

a first rotary member which moves along the spine of the folded sheet bundle while rotating, and nips the folded sheet bundle such that the spine of the folded sheet bundle projects by a predetermined amount from an end in an axial direction of the first rotary member;

a pressing rotary member which (i) is provided corresponding to the first rotary member in a moving direction of the processing portion when the processing portion performs a deforming process on the spine, (ii) moves along the spine of the folded sheet bundle while rotating, and (iii) presses the spine projecting from the end in the axial direction of the first rotary member; and a second rotary member which (i) is provided downstream of the first rotary member in the moving direction of the processing portion, (ii) moves along the spine of the folded sheet bundle while rotating, and (iii) nips the folded sheet bundle including the spine, wherein the end of the first rotary member from which the spine projects is displaced, in the axial direction, relative to a corresponding end of the second rotary member.

2. The sheet processing apparatus according to claim 1, wherein the pressing rotary member is arranged in a position opposing to a nip of the first rotary member.

3. The sheet processing apparatus according to claim 2, wherein a length in the axial direction of the second rotary member is greater than a length in the axial direction of the first rotary member.

4. The sheet processing apparatus according to claim 3, wherein an end in the axial direction of the second rotary member projects from the spine of the folded sheet bundle when the processing portion performs the deforming process on the spine.

5. The sheet processing apparatus according to claim 1, further comprising a folding portion which folds the sheet bundle while the folding portion is conveying the sheet bundle, wherein the processing portion, provided downstream of the folding portion, deforms the spine of the sheet bundle folded by the folding portion.

6. The sheet processing apparatus according to claim 1, wherein an amount of projection from the end in the axial direction the first rotary member of the spine of the folded sheet bundle having higher rigidity than a predetermined rigidity is greater than an amount of projection of the spine of the folded sheet bundle having less than or equal to the predetermined rigidity.

7. An image forming apparatus comprising:

an image forming portion which forms an image on a sheet;

a folding portion which folds the sheet on which the image is formed by the image forming portion; and a processing portion which moves along a spine of a folded sheet bundle while pressing the spine of the sheet bundle folded by the folding portion to deform the spine into a square shape, wherein the processing portion includes:

a first rotary member which moves along the spine of the folded sheet bundle while rotating, and nips the folded sheet bundle such that the spine of the folded sheet bundle projects by a predetermined amount from an end in an axial direction of the first rotary member;

a pressing rotary member which (i) is provided corresponding to the first rotary member in a moving direction of the processing portion when the processing portion performs a deforming process on the spine, (ii) moves along the spine of the folded sheet bundle while rotating, and (iii) presses the spine projecting from the end in the axial direction of the first rotary member; and a second rotary member which (i) is provided downstream of the first rotary member in the moving direction of the processing portion, (ii) moves along the spine of the folded sheet bundle while rotating, and (iii) nips the folded sheet bundle including the spine, wherein the end of the first rotary member from which the spine projects is displaced, in the axial direction, relative to a corresponding end of the second rotary member.

8. The image forming apparatus according to claim 7, wherein the pressing rotary member is arranged in a position opposing to a nip of the first rotary member.

9. The image forming apparatus according to claim 8, wherein a length in the axial direction of the second rotary member is greater than a length in the axial direction of the first rotary member.

10. The image forming apparatus according to claim 9, wherein an end in the axial direction of the second rotary member projects from the spine of the folded sheet bundle when the processing portion performs the deforming process on the spine.

11. The image forming apparatus according to claim 8, wherein an amount of projection from the end in the axial direction of the first rotary member, of the spine of the folded sheet bundle having higher rigidity than a predetermined rigidity is greater than an amount of projection of the spine of the folded sheet bundle having less than or equal to the predetermined rigidity.

12. The image forming apparatus according to claim 7, wherein an amount of projection from the end in the axial direction of the first rotary member of the spine of the folded sheet bundle having higher rigidity than a predetermined rigidity is greater than an amount of projection of the spine of the folded sheet bundle having less than or equal to the predetermined rigidity.

* * * * *